US009856699B2

(12) United States Patent
Anderson

(10) Patent No.: US 9,856,699 B2
(45) Date of Patent: Jan. 2, 2018

(54) METHODS AND APPARATUS FOR FORMING HOLE IN GROUND

(71) Applicant: Paul L. Anderson, Alexandria, MN (US)

(72) Inventor: Paul L. Anderson, Alexandria, MN (US)

( * ) Notice: Subject to any disclaimer, the term of this patent is extended or adjusted under 35 U.S.C. 154(b) by 280 days.

(21) Appl. No.: 14/661,837

(22) Filed: Mar. 18, 2015

(65) Prior Publication Data

US 2015/0267473 A1 Sep. 24, 2015

Related U.S. Application Data

(60) Provisional application No. 61/954,636, filed on Mar. 18, 2014.

(51) Int. Cl.
*E21B 7/02* (2006.01)

(52) U.S. Cl.
CPC ..... *E21B 7/028* (2013.01)

(58) Field of Classification Search
None
See application file for complete search history.

(56) References Cited

U.S. PATENT DOCUMENTS 2,912,228 A 7/1957 Kandle
3,049,185 A * 8/1962 Herbold ..... E21B 7/206 166/233
3,327,789 A * 6/1967 Furuseth ..... E21B 3/02 173/159
3,391,748 A * 7/1968 Bodine ..... E21B 7/24 175/56
3,710,876 A 1/1973 Christensen
3,746,104 A 7/1973 McIntosh et al.
3,896,570 A 7/1975 McMurray
4,066,134 A * 1/1978 Karns, III ..... E21B 19/087 173/27
4,193,459 A 3/1980 Engstrom
4,246,974 A 1/1981 Rothrock
4,679,637 A 7/1987 Cherrington et al.
4,682,659 A 7/1987 Holopainen
4,836,294 A 6/1989 Bencriscutto
4,836,301 A * 6/1989 Van Dongen ..... E21B 7/065 175/256
4,938,297 A 7/1990 Schmidt ..... 175/19
5,042,600 A 8/1991 Finnegan et al. ..... 175/323
5,076,730 A 12/1991 Bergey
(Continued)

*Primary Examiner* — Shane Bomar
(74) *Attorney, Agent, or Firm* — Alan D. Kamrath; Kamrath IP Lawfirm, P.A.

(57) ABSTRACT

An apparatus for forming a hole in ground (10) includes a mounting plate (60) mounted to a loader (80). A probe (11) is coupled with the mounting plate (60) through a hydraulic motor (120) having an output shaft (122). The probe (11) is driven into the ground along the vertical axis by movement of the mounting plate (60) by the loader (80), and an upper portion of the probe (11) is simultaneously wobbled about two axes that are perpendicular to each other and to the vertical axis while the output shaft (122) is rotating. The probe (11) is then moved out of the ground to leave a hole (100) in the ground. To provide a rolling action against the sides of the hole (100), the upper end of the probe (11) is moved about an annular path around the vertical axis while the probe (11) is rotating.

15 Claims, 8 Drawing Sheets

(56) References Cited

U.S. PATENT DOCUMENTS

| | | | | |
|---|---|---|---|---|
| 5,101,912 | A | 4/1992 | Smet | |
| 5,111,888 | A | 5/1992 | Wimmer | |
| 5,556,217 | A | 9/1996 | Deyo et al. | |
| 5,797,705 | A | 8/1998 | Kellner | 405/253 |
| 5,868,211 | A * | 2/1999 | Bohn | E21B 7/028 173/27 |
| 6,092,610 | A * | 7/2000 | Kosmala | E21B 4/20 175/27 |
| 6,273,652 | B1 | 8/2001 | Wirth, Jr. et al. | |
| 6,619,413 | B2 | 9/2003 | Hamilton et al. | |
| 6,764,139 | B1 | 7/2004 | Wortman | |
| 6,889,777 | B2 | 5/2005 | Boley et al. | |
| 6,902,014 | B1 | 6/2005 | Estes | |
| 7,083,010 | B2 | 8/2006 | Eppink et al. | |
| 7,152,694 | B2 | 12/2006 | Dennis | |
| 7,357,200 | B2 | 4/2008 | Harleman | 175/323 |
| 7,658,240 | B2 | 2/2010 | Anderson | 175/19 |
| 8,820,435 | B2 | 9/2014 | Niekamp | 175/19 |
| 2003/0047359 | A1 | 3/2003 | Shupe | |
| 2004/0262043 | A1* | 12/2004 | Schuaf | E21B 3/02 175/57 |
| 2005/0236189 | A1* | 10/2005 | Rankin, III | E21B 4/006 175/73 |
| 2009/0194334 | A1 | 8/2009 | Johnson et al. | |

* cited by examiner

METHODS AND APPARATUS FOR FORMING HOLE IN GROUND

CROSS REFERENCE

The present application claims benefit of U.S. Application No. 61/954,636 filed on Mar. 18, 2014.

BACKGROUND

Methods and apparatus for forming a hole in ground and, more particularly, methods and apparatus for moving a probe attached to a loader or the like for rapidly forming a hole in the ground are shown and described.

Postholes for fence posts, flag poles or the like can be formed with the use of an auger. Digging a hole in the ground with the auger, inserting a post into the hole, and filling dirt and tamping the dirt around the post are laborious and very time consuming. Another approach is to drive posts into the ground by a pile driver, but this is typically limited to strong posts of a limited cross sectional size. Another approach utilizes a tapered bar attached to a bucket of a loader and driven into the ground to form a hole. A post is then inserted into the hole. However, such approach has deficiencies in forming the hole as it relies upon the mass of the loader, and there is considerable friction between the tapered bar and the ground when making the hole in the ground. U.S. Pat. No. 7,658,240 discloses an improved approach to rapidly form a hole in the ground by driving and moving a probe. However, utilization of the approach of U.S. Pat. No. 7,658,240 brought an appreciation of its significant improvement over other approaches and the desirability of further improvement.

Thus, a need exists for methods and apparatus that can rapidly form a hole in the ground, which overcome the deficiencies of the prior approaches, and that allow easy placement of a post in the hole.

SUMMARY

This need and other problems in the field of forming holes in the ground for posts and the like are solved by providing, in a first aspect, novel methods and apparatus for rapidly forming a hole in the ground.

An apparatus includes, in a form shown, a mounting plate adapted to be mounted to a bucket of a loader. A probe is coupled with the mounting plate and includes a bottom end spaced from the mounting plate along a vertical axis perpendicular to the ground. The bottom end of the probe is adapted to be inserted in the ground. The probe is movable along the vertical axis into the ground by movement of the mounting plate by the loader to move the mounting plate along the vertical axis and simultaneously moving the probe extending from the bottom end at an acute angle to the vertical axis, to form a hole of a generally conical shape without removing soil. In forms shown, the probe is moved by a hydraulic motor connected intermediate the mounting plate and the probe. The hydraulic motor can be connected providing or preventing movement relative to the mounting plate. The acute angle can be created by a bend in the probe, which can be adjustable, with the hole created by rotating the axis of the probe spaced from the output shaft of the hydraulic motor or the like. The probe is movable out of the ground along the vertical axis to leave a hole in the ground.

In aspects described, a universal joint connects the hydraulic motor to the mounting plate to allow the upper end of the probe connected to the hydraulic motor to move relative to the mounting plate about a first axis perpendicular to the vertical axis and a second axis perpendicular to the first axis and to the vertical axis. In one form, the hydraulic motor is mounted to a movement plate pivotally and tiltably mounted to the mounting plate. The movement plate can be mounted to the mounting plate by a tie rod and by another hydraulic motor having an output shaft connected to a flange of the mounting plate by an adjustable offset pin bearing. In another form, the probe is movably mounted in an annular shape concentric to the output shaft of the hydraulic motor and is rotatably related thereto. In such forms, the probe is rotated in an opposite rotational direction than the rotational direction of the hydraulic motor to create a rolling action to the probe against the sides of the hole created in the ground.

In aspects described, a universal joint connects the probe having a bend to the hydraulic motor so that the lower section of the probe at the bend moves relative to the mounting plate about a first axis perpendicular to the vertical axis and a second axis perpendicular to the first axis and to the vertical axis.

A method for forming a hole in ground includes, in an example, driving a probe into ground along a vertical axis. The probe has a bottom, pointed end and an upper portion spaced from the bottom end along the vertical axis. While the probe is being driven into the ground, the probe is held at an angle to the vertical axis, and the upper portion of the probe is simultaneously wobbled about two axes perpendicular to each other and to the vertical axis. In forms shown, the probe is wobbled by a hydraulic motor connected to the mounting plate to allow or to prevent relative movement. After the probe is driven into the ground, the probe is moved upward from the ground along the vertical axis, leaving a hole in the ground.

In aspects described, the upper end of the probe moves about an annular path around the vertical axis while the probe is being rotated by the hydraulic motor. In one form, the hydraulic motor is mounted to a movement plate which is pivotally and tiltably mounted to the mounting plate by a tie rod and by another hydraulic motor having an output shaft connected to a flange of the mounting plate by an adjustable offset pin bearing. In another form, the upper end of the probe moves in a circular path concentric to the vertical axis and is rotatably related to the output shaft of the hydraulic motor. A rolling action is created by the probe against the sides of the hole when the movement direction of the probe in the annular path is opposite to the direction of probe rotation.

In aspects described, simultaneously wobbling is created by mounting the hydraulic motor to the mounting plate by a universal joint, with the output shaft of the hydraulic motor coupled to a probe having a bend at the upper end to have an acute connection angle to the remaining portion of the probe.

A weight can be mounted on an upper side of the horizontal section of the mounting plate to assist in forming the hole. Likewise, a vibrator can be mounted on the mounting plate to vibrate the mounting plate and the probe along the vertical axis.

Illustrative embodiments will become clearer in light of the following detailed description in connection with the drawings.

DESCRIPTION OF THE DRAWINGS

The illustrative embodiments may best be described by reference to the accompanying drawings where.

Figure 1:
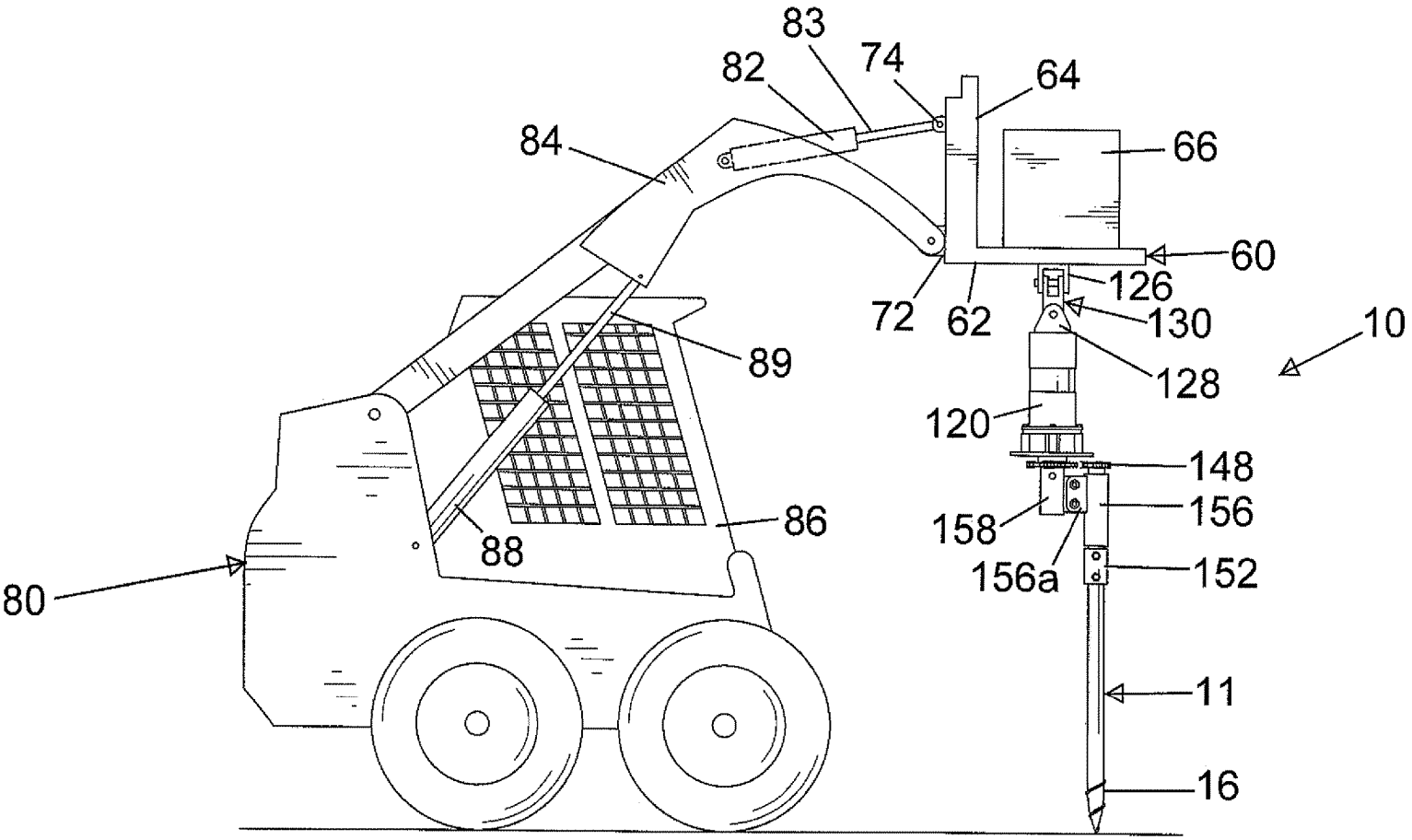
FIG. 1 shows a side elevational view of a loader with a hole forming apparatus.

All figures are drawn for ease of explanation of the basic teachings of the present invention only; the extensions of the figures with respect to number, position, relationship, and dimensions of the parts to form the illustrative embodiments will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "upper", "lower", "bottom", "end", "side", "portion", "section", "horizontal", "vertical", "radial", "sideway", and similar terms are used herein, it should be understood that these terms have reference only to the structure shown in the drawings as it would appear to a person viewing the drawings and are utilized only to facilitate describing the illustrative embodiments.

DESCRIPTION OF THE ILLUSTRATIVE EMBODIMENTS

An illustrative embodiment of an apparatus and methods which can rapidly form a hole in the ground is shown in the drawings and generally designated 10. Apparatus 10 can be conveniently coupled to a mounting plate 60 such as a bucket of a loader 80. Loader 80 may be a skid steer loader, payloader, boom truck, crane or the like. In the preferred form shown, mounting plate 60 attached to a skid steer loader is substantially L-shaped and includes a vertical section 64 and a horizontal-section 62. Two spaced lugs 72 are provided on a lower portion of a rear side of vertical section 64 for pivotal connection with front ends of a pair of arms 84 of loader 80. A rear end of each arm 84 is connected to a front end of a piston rod 89 of a hydraulic cylinder 88. Two pairs of ears 74 are provided on an upper portion of the rear side of vertical section 64 for pivotal connection with front ends of piston rods 83 of a pair of hydraulic cylinders 82. Hydraulic cylinders 82 and 88 allow a driver in a cab 86 of loader 80 to control movements of mounting plate 60. Other arrangements for driving mounting plate 60 would be within the skill of the art.

Generally, apparatus 10 includes a probe 11 which may be tubular or solid and may be of any desired form, such as rectangular, square, round, oval, etc. in section. In the form shown, probe 11 is cylindrical and includes a lower section 16 and an upper end 18. In the form shown, lower section 16 is conical in shape and includes a spiral flight 17 creating a threaded portion. Spiral flight 17 only on the conical shaped lower section 16 helps probe 11 to go into the ground while not tending to draw dirt to the surface in an auger like manner.

Apparatus 10 further includes suitable provisions for moving probe 11 relative to mounting plate 60. Particularly, a hydraulic motor 120 having an output shaft 122 is coupled between mounting plate 60 and probe 11. In illustrative embodiments, hydraulic motor 120 is mounted by a universal joint 124 to mounting plate 60. Universal joint 124 includes two spaced lugs 126 mounted to mounting plate 60 and two spaced lugs 128 mounted to hydraulic motor 120. An intermediate component 130 has a first lug 132 pivotally connected to lugs 126 by a pin 134 and a second lug 136 pivotally connected to lugs 128 by a pin 138, with pins 134 and 138 being in parallel spaced planes and perpendicular to each other. It should be appreciated that universal joint 124 can take other forms and types to allow movement of hydraulic motor 120 relative to mounting plate 60.

In a form shown, a first gear 140 is fixed to hydraulic motor 120 concentrically to output shaft 122 such as being mounted to a plate 142 held by spacers 144 to hydraulic motor 120. First gear 140 is in gearing relation to a second gear 146, such as by a roller chain 148 as shown. However, other manners of providing a gearing relation can be utilized including, but not limited to, by both being in engagement with an idler gear, by both being in respective engagement with rotatably related idler sprockets by engagement or through roller chains, or the like. Second gear 146 is mounted to the upper end of a stub shaft 150 suitably coupled to upper end 18 of probe 11 such as by a coupler 152. A rotatable connector 154 includes a first sleeve 156 rotatably receiving stub shaft 150 and a second sleeve 158 rotatably fixed to output shaft 122, with output shaft 122 and stub shaft 150 being in a spaced, parallel relation. Thus, upper end 18 of probe 11 moves while rotating about an annular path of a circular shape concentric around output shaft 122. In the form shown, sleeves 156 and 158 are removably interconnected together by ears **156*a* and 158*a* to allow sleeves 156 and/or 158 having different lengths of ears 156*a* and 158*a*** to be utilized.

In another form shown, probe 11 includes a bend such that upper end 18 and lower section 16 have axes at an angle to each other. Furthermore, in the form shown, the angle of the axes of upper end 18 and lower section 16 is adjustable. Specifically, in the form shown, probe 11 includes a locking joint 160 including first and second discs 162 and 164 each having interlocking teeth facing each other. A fastener 166 allows discs 162 and 164 to be separated from each other to allow rotation from being generally straight to the desired angle and for forming the desired hole size in the ground and then brought together to intermesh the interlocking teeth to hold discs 162 and 164 at that desired angle. Upper end 18 is suitably coupled to output shaft 122 such as by a coupler 168.

In a further form shown, hydraulic motor 120 is mounted without relative movement to mounting plate 12. Probe 11, having a bend created by locking joint 160, is coupled to output shaft 122 by a universal joint 224. Universal joint 224 includes an intermediate component 230 having first lugs 232 pivotally connected to output shaft 122 by a pin 234 extending through lugs 232 and a bore **122*a* extending radially through output shaft 122. Intermediate component 230 further has second lugs 236 pivotally connected to probe 11 by a pin 238 extending through lugs 236 and a bore 18***a* extending radially through upper end 18 of probe 11.

In still another form shown, mounting plate 60*a* includes a vertical section 64*a*, two spaced lower flanges 62*a* and 62*b* extending generally horizontally adjacent a lower edge thereof and an upper flange 62*c* extending horizontally adjacent an upper edge thereof parallel to but intermediate lower flanges 62*a* and 62*b*. Hydraulic motor 120 having output shaft 122 is coupled between mounting plate 60*a* and probe 11. In illustrative embodiments, hydraulic motor 120 is mounted by universal joint 124 to upper flange 62*c*. Probe 11 is coupled to output shaft 122 by universal joint 224. Hydraulic motor 120 is further mounted to a movement plate 260. Movement plate 260 is pivotally and tiltably mounted to mounting plate 60*a* by a tie rod 262 having opposite ends 262*a* and 262*b* pivotally and tiltably mounted by parallel axes to lower flange 62*a* and to movement plate 260. A second hydraulic motor 220 is mounted to movement plate 60*a* and includes an output shaft 222 arranged parallel to and spaced from output shaft 122. An adjustable offset pin bearing 240 is fixed to output shaft 222 and generally includes a disk 240*a* rotatably fixed to output shaft 222. An orbital shaft 240*b* is fixed to lower flange 62*b* parallel to and spaced from output shafts 122 and 222. The upper end of shaft 240*b* is pivotally and tiltably received in disk 240*a* about an axis spaced from and parallel to output shaft 222. In the form shown, flange 62*b* is hingedly connected to vertical section 64*a*. Output shaft 222 of hydraulic motor 220 rotates in the opposite direction as output shaft 122 of hydraulic motor 120. Thus, upper end 18 of probe 11 while rotating due to hydraulic motor 120 moves about an annular, orbital, path around the vertical axis due to hydraulic motor 220 moving movement plate 260, with movement plate 260 having both pivotal and tilting movement. The radius of the annular, orbital path can be set by adjustment of adjustable offset pin bearing 240 according to the size of hole 100 desired.

Now that the basic construction of apparatus 10 has been set forth, a method of operation can be explained, and some of the advantages obtained thereby highlighted. After loader 80 is moved into position and mounting plate 60, 60*a* is lifted, mounting plate 60, 60*a* is moved downward under control of hydraulic cylinders 82 and 88 of loader 80 to drive probe 11 into ground 102 to form a hole 100 in ground 102. Simultaneously, probe 11 is moved around to push dirt aside to form a nice clean hole without removing soil and so that there is little or even no friction between probe 11 and the side of hole 100. Particularly, probe 11, extending from lower section 16 to upper end 18 at an acute angle to a line extending from lower section 16 to the location where hydraulic motor 120 is secured to mounting plate 60, 60*a*, which is generally vertical, is moved by hydraulic motor 120 to form a hole 100 of a generally conical shape. Specifically, the upper portion of probe 11 wobbles about first and second axes perpendicular to the vertical axis and each other. Hydraulic motor 120 can be operated to obtain any type of orbital and back-and-forth motions of probe 11 with control valves. It is noted that the bottom of hole 100 becomes the pivot point when the upper portion of probe 11 is moved around. In an example, the upper portion of probe 11 is moved and then downward pressure is applied to probe 11 by loader 80. In another example, the upper portion of probe 11 is moved somewhat circular. By moving probe 11 in these ways, most effective deepening can occur when probe 11 is in the center of hole 100. This is because the downward pressure is completely applied to lower section 16 of probe 11. Since probe 11 "wobbles", hole 100 in ground 102 is larger than probe 11 except at lower section 16 of probe 11, such that the sidewall of hole 100 is firmly packed by probe 11 moving in a circular, orbitally rolling motion on the sidewall of the hole and such that friction with probe 11 is minimized during use.

The motion at the upper portion or path of probe 11 provides the most effective way to deepen hole 100. By moving the upper portion of probe 11 all around the sides of hole 100 to force the dirt to the sides of hole 100 and then moving probe 11 to the center of hole 100, there is little or no friction on the upper portion of probe 11, for all the downward pressure gets focused on lower section 16 of probe 11.

Furthermore, a weight or vibrator 66 can be mounted on horizontal section 62 for performing or assisting in the hole-forming operation of probe 11. In a case a weight is used, the weight can be simply a large mass. In another case, a vibrator is used, with the vibrator being reversible so that in one mode of operation the vibrator helps probe 11 to be driven into ground 102 and in another mode of operation, the vibrator helps probe 11 being removed from hole 100 in ground 102.

Hole 100 can be used for many purposes including but not limited to mount a post, pole, flag pole or the like. Specifically, a post or the like is inserted into hole 100 in ground 102, and dirt is filled around the post and in hole 100 to firmly grip the post in hole 100. The bottom of the post requires little or no tamping. Furthermore, the post can be mounted in hole 100 without the power of loader 80, for hole 100 thus formed is large and deep enough.

Apparatus 10 allows rapid forming of holes (faster than drilling a hole by an auger) and will slip by rocks or push the rocks to the side. Furthermore, apparatus 10 makes a firmer setting for a pole or post, for probe 11 pushes or packs dirt to the side of hole 100. Furthermore, hole 100 formed by probe 11 is large enough and, thus, allows easy placing of a pole or post. Furthermore, apparatus 10 requires less maintenance and less expensive equipment than conventional auger equipment. Furthermore, apparatus 10 allows easy and accurate locating of hole 100 by a laser beam. Further, when punching a hole 100 with apparatus 10, the probe size can be the exact size of the post so that the bottom of the post requires little or no tamping, and there is no messy pile of dirt that is apt to be produced with conventional auger equipment.

Figure 2:
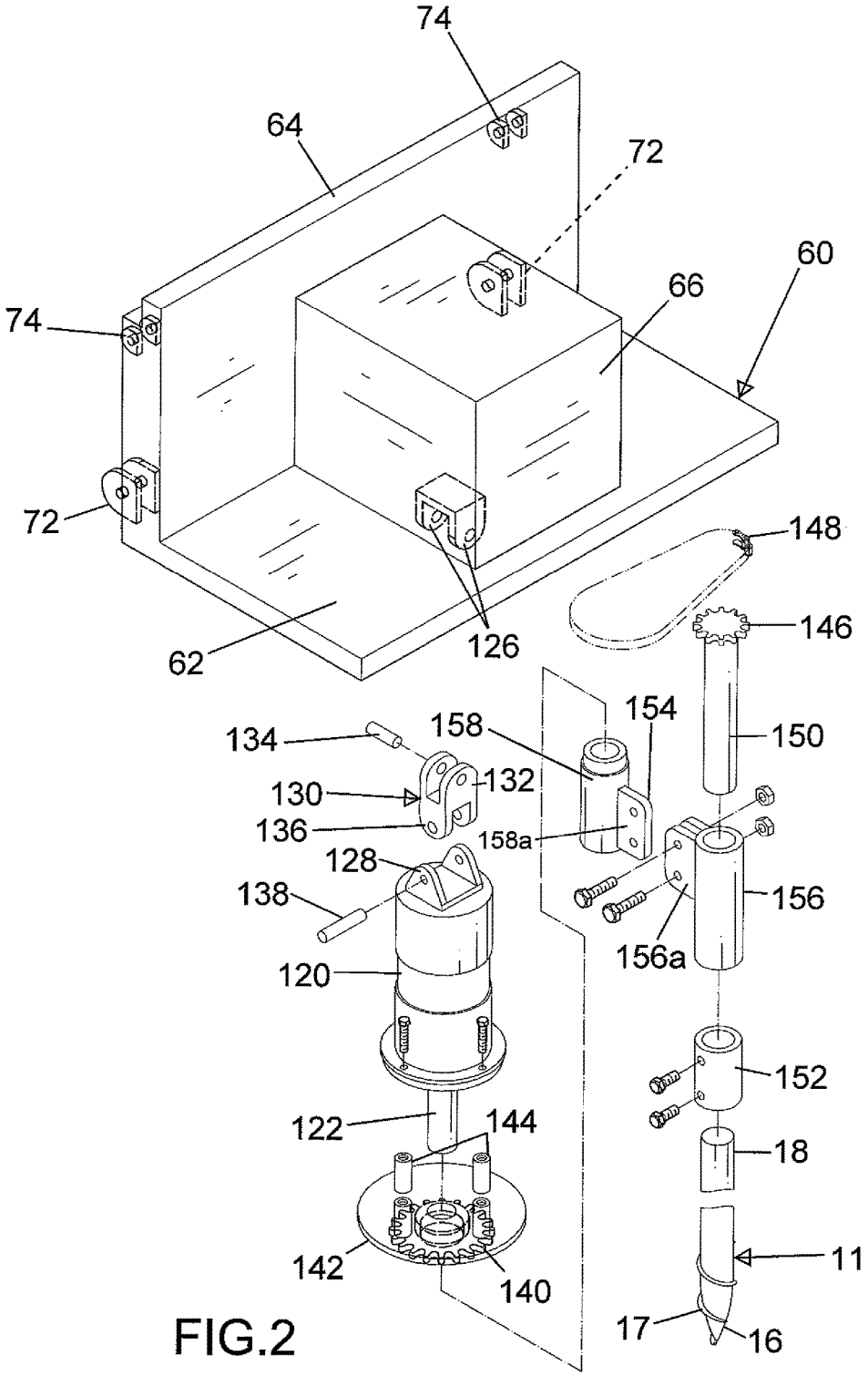
FIG. 2 shows an exploded perspective view of the apparatus of FIG. 1.
Figure 3:
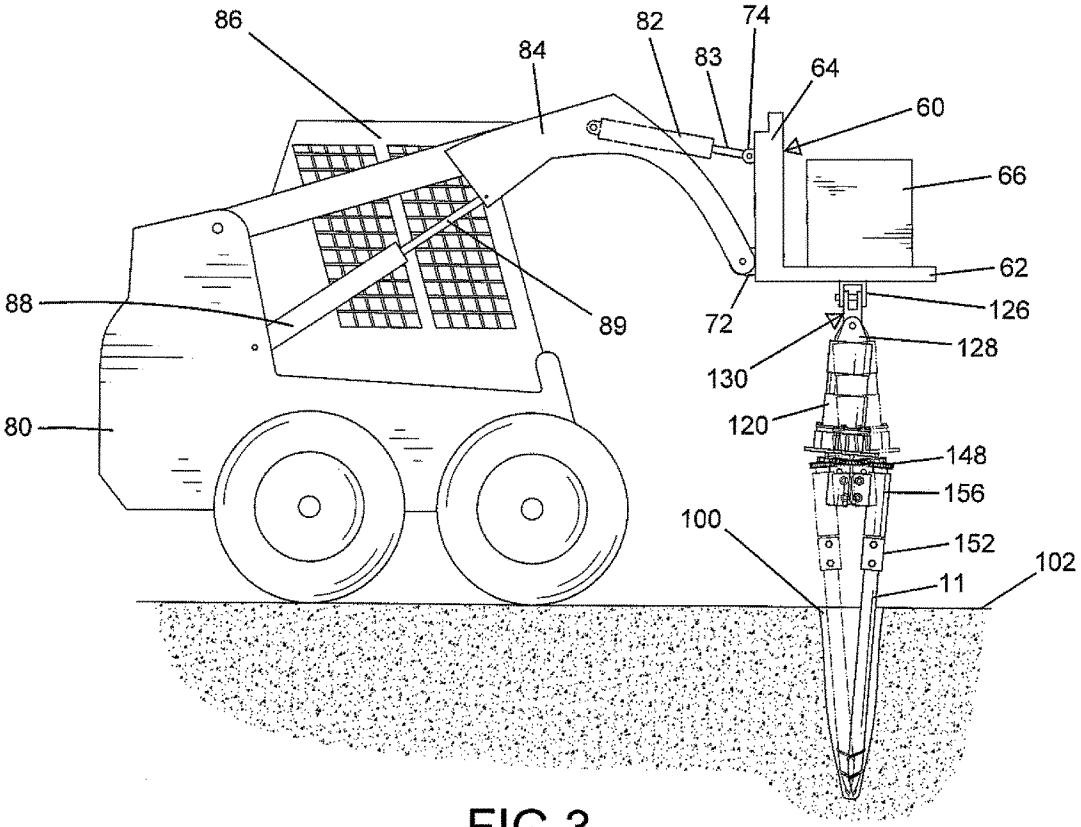
FIG. 3 shows a side elevational view showing operation of the apparatus of FIG. 1.
Figure 4:
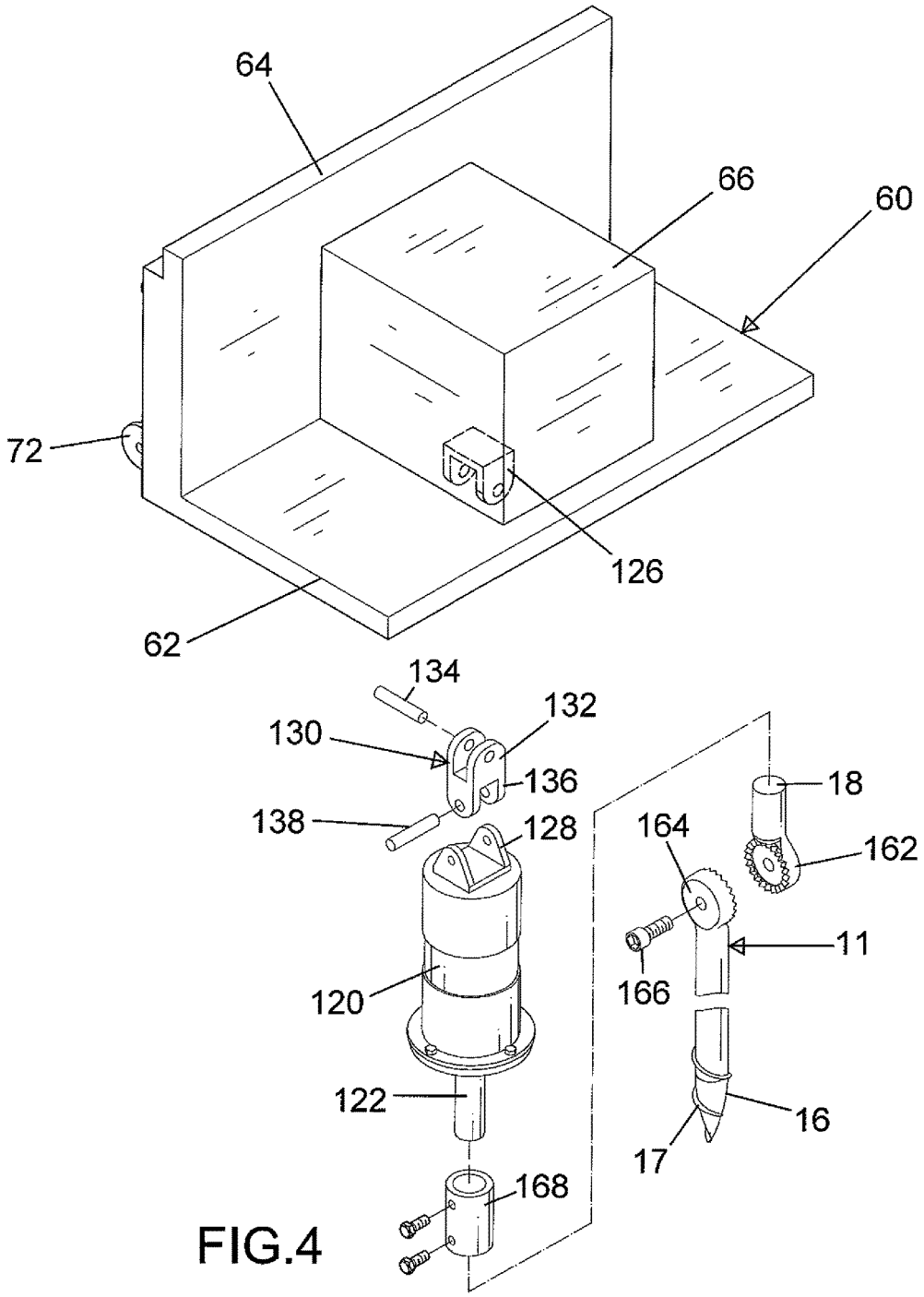
FIG. 4 shows an exploded perspective view of an alternate form of a hole forming apparatus.
Figure 5:
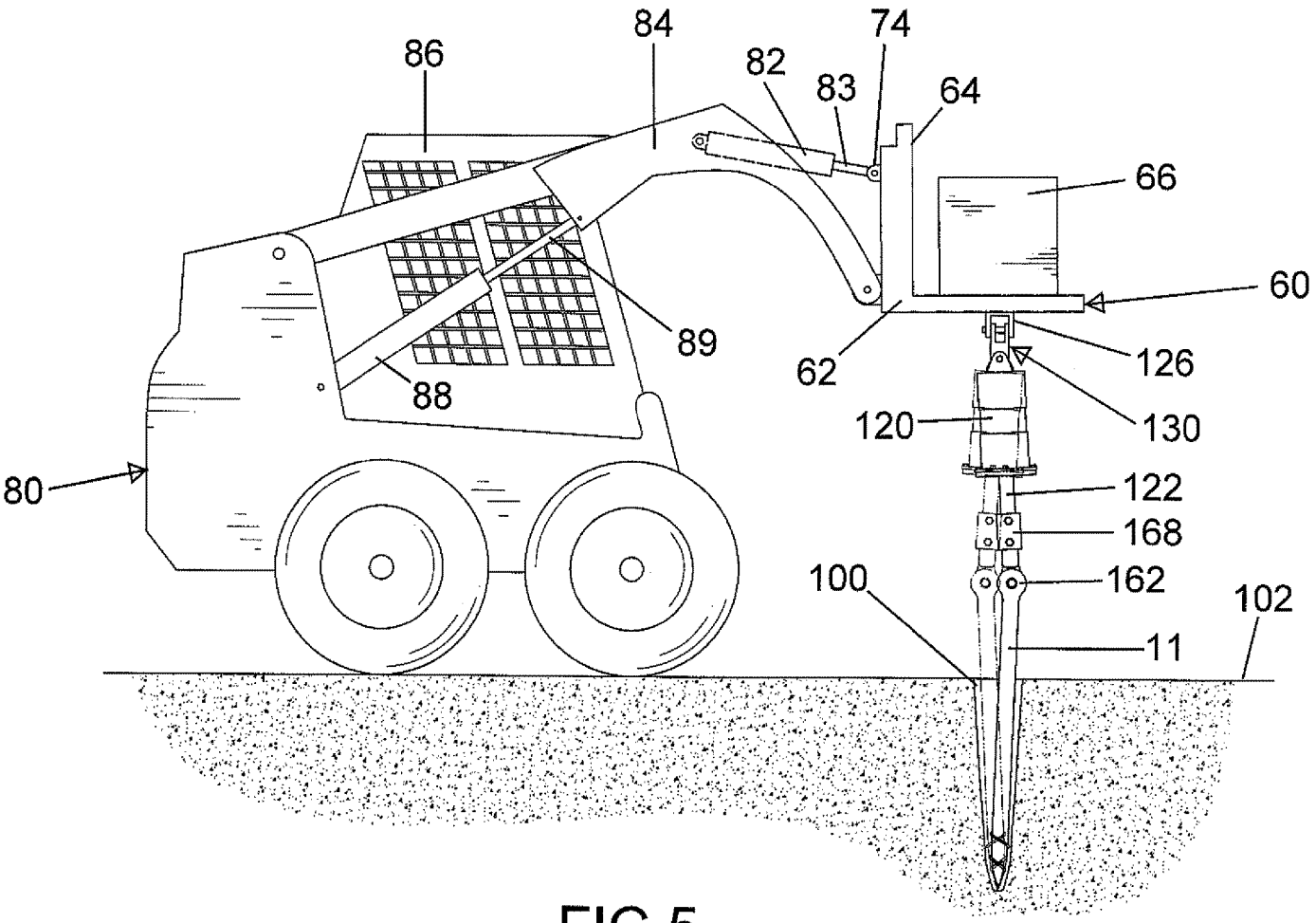
FIG. 5 shows a side elevational view showing operation of the apparatus of FIG. 4.
Figure 6:
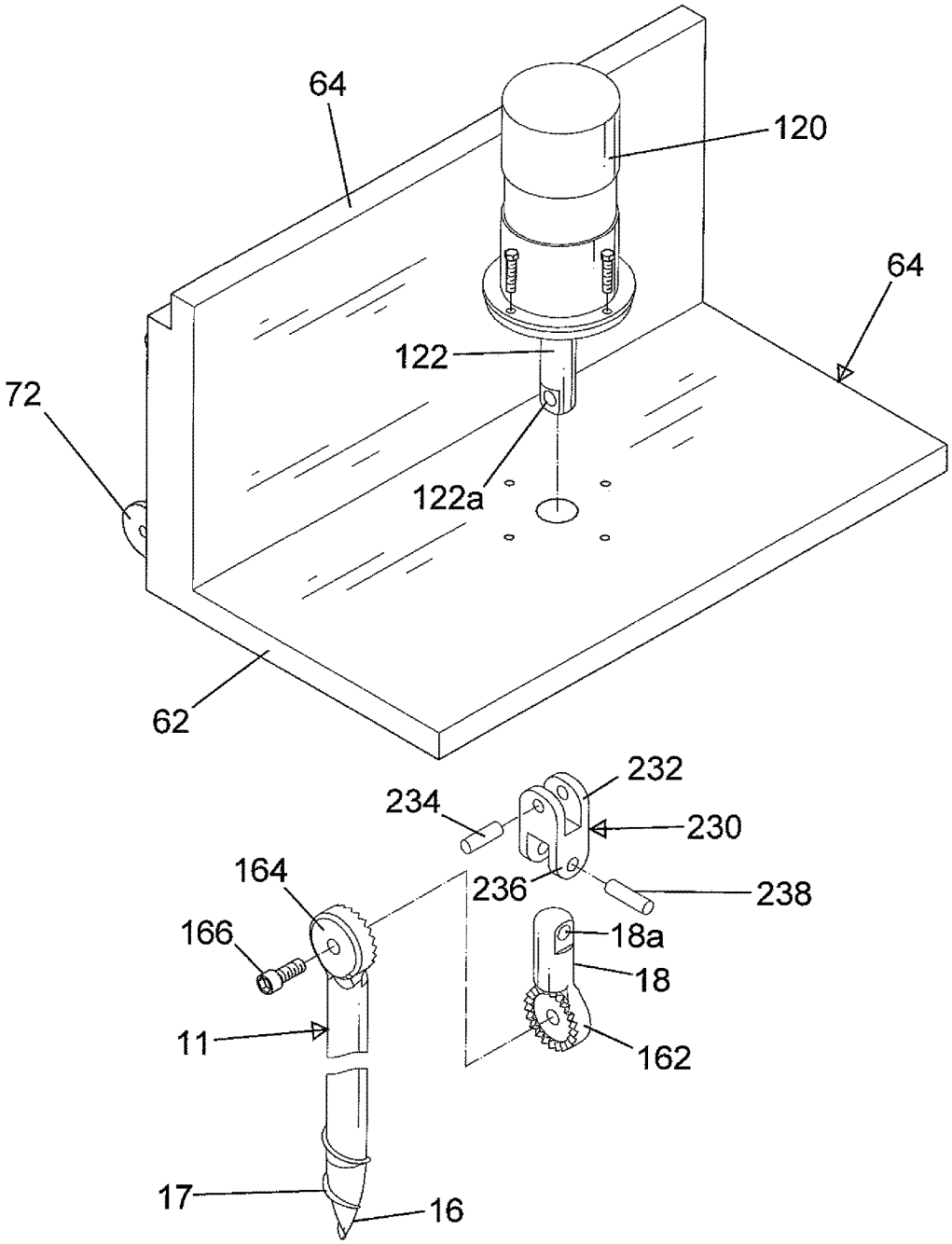
FIG. 6 shows an exploded perspective view of an alternate form of a hole forming apparatus.
Figure 7:
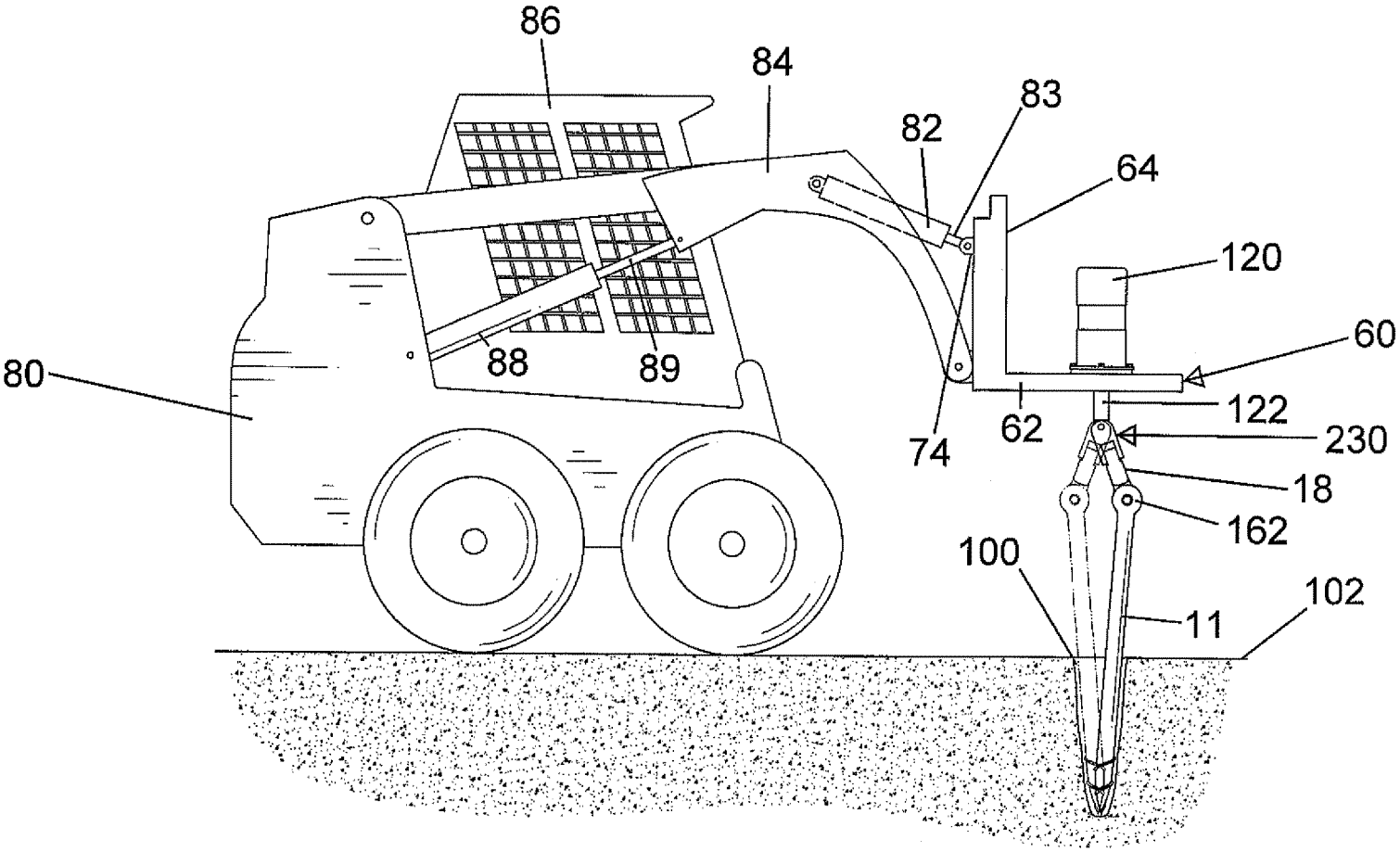
FIG. 7 shows a side elevational view showing operation of the apparatus of FIG. 6.
Figure 8:
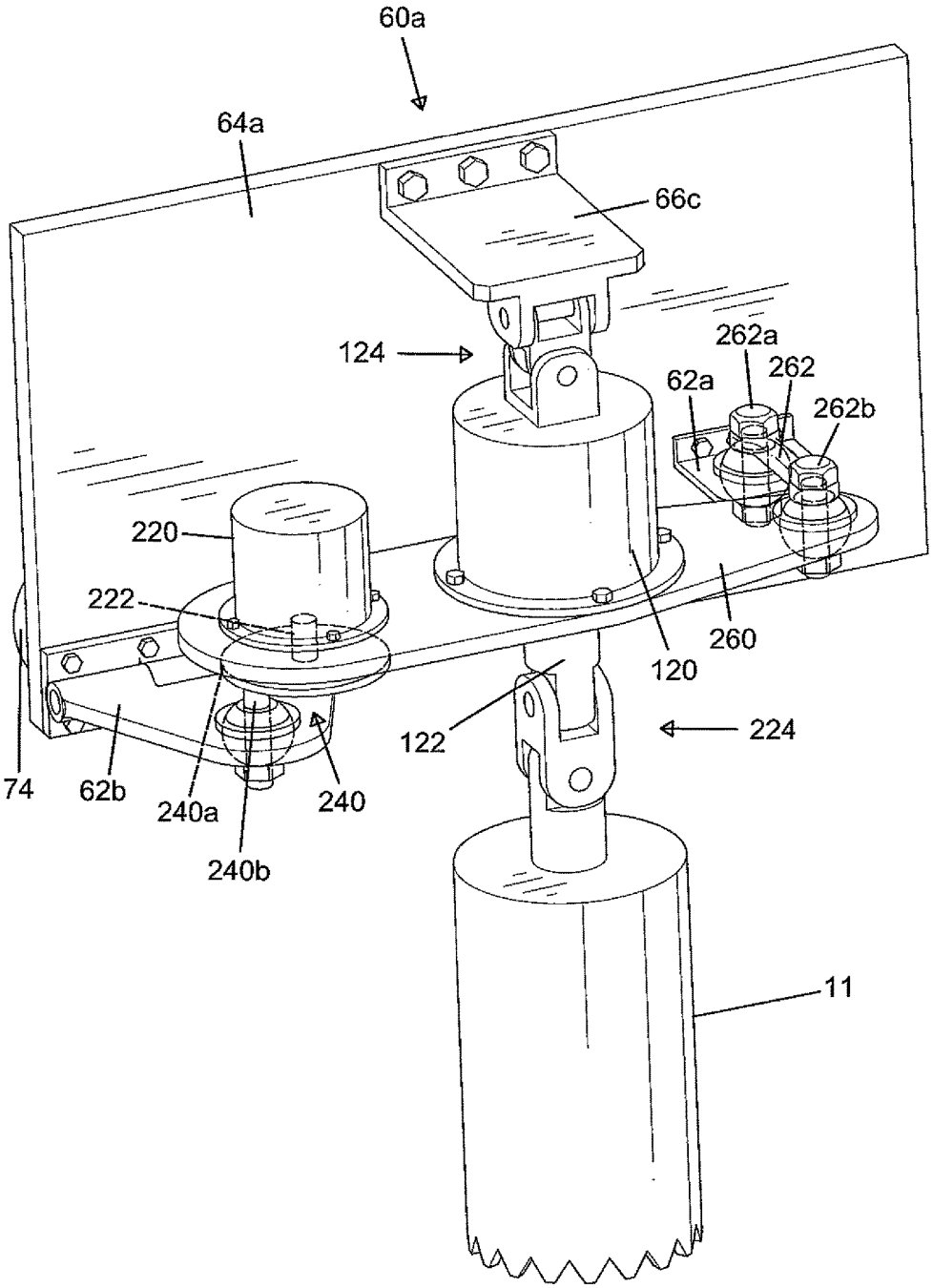
FIG. 8 shows a partial perspective view of an alternate form of a hole forming apparatus.

In all the illustrative embodiments, probe 11 is driven into ground along a vertical axis, with the probe having a bottom, pointed end and an upper portion spaced from the bottom end along the vertical axis. While probe 11 is being driven into the ground, the upper portion of probe 11 is simultaneously wobbling about a first axis perpendicular to the vertical axis and a second axis perpendicular to the vertical axis and to the first axis to move upper portion of probe 11 all around the sides of hole 100 to force dirt to the sides of the hole by rotation and in the forms shown by use of hydraulic motor 120. By doing so, there is little or no friction on the upper portion of probe 11, to focus downward pressure on the bottom, pointed end 28 of probe 11. In this regard, the illustrative embodiments of probe 11 are generally of a cylindrical shape having circular cross sections having centers arranged along a linear straight line, and of a constant size over most of its linear length, allowing for ease of fabrication at lesser cost. The wobbling motion about the first and second axes perpendicular to the vertical axis of hole 100 and each other is provided by creating a desired angle in locking joint 160 or by moving the upper end of probe 11 away from the vertical axis defined by the center axis of hole 100 while lower section 16 remains at the vertical axis defined by the center axis of hole 100. It should be appreciated that use of hydraulic motors 120 and 220 provides continuous motion to create the wobbling motion, reducing momentum change forces which are placed upon apparatus 10. Furthermore, separate rotation of probe 11 in an opposite rotational direction as provided by hydraulic motor 120 as provided in the forms shown in FIGS. 1-3 and 8 creates a rolling action to probe 11 to roll against the sides of hole 100 to expand hole 100. Such a rolling action reduces friction to extend wear life as well as reduce energy requirements.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A method for forming a hole in ground comprising:

rotating a probe about a probe axis of rotation, with the probe having a bottom, pointed end and an upper end spaced from the bottom end along the probe axis of rotation;

driving the probe while rotating into ground along a vertical axis;

while the probe is being driven into the ground and rotating, simultaneously wobbling the upper portion of the probe about a first axis perpendicular to the vertical axis and a second axis perpendicular to the vertical axis and perpendicular to the first axis by moving the upper end of the probe away from the vertical axis to angle the probe axis of rotation relative to the vertical axis, wherein simultaneously wobbling comprises moving the upper end of the probe while rotating about an annular path around the vertical axis; and after the probe is driven into the ground, moving the probe upward from the ground along the vertical axis, leaving a hole in the ground, wherein rotating the probe comprises rotating the probe along the probe axis of rotation fixed relative to a movement plate; with the movement plate having a first end pivotally and tiltably mounted to a tie rod about a first axis, with the tie rod being pivotally and tiltably mounted to a mounting plate about a second axis spaced from a parallel to the first axis; and moving a second end of the movement plate about an orbital path, with the probe axis of rotation being intermediate the first and second ends of the movement plate.

2. The method of claim 1, wherein moving the second end comprises rotating an output shaft parallel to and spaced from the probe axis and fixed to the movement plate; providing an orbital shaft fixed to the mounting plate parallel to and spaced from the output shaft; and rotatably and tiltably interconnecting the orbital shaft to the output shaft radially spaced from and parallel to the output shaft.

3. The method of claim 2, wherein rotatably interconnecting comprises providing a disk fixed to the output shaft, and pivotally and tiltably receiving the orbital shaft in the disk.

4. The method of claim 1, wherein moving the upper end comprises moving the upper end of the probe while rotating about the annular path of a circular shape concentric to the vertical axis.

5. A method for forming a hole in ground comprising:

rotating a probe about a probe axis of rotation, with the probe having a bottom, pointed end and an upper end spaced from the bottom end along the probe axis of rotation;

driving the probe while rotating into ground along a vertical axis;

while the probe is being driven into the ground and rotating, simultaneously wobbling the upper portion of the probe about a first axis perpendicular to the vertical axis and a second axis perpendicular to the vertical axis and perpendicular to the first axis by moving the upper end of the probe away from the vertical axis to angle the probe axis of rotation relative to the vertical axis, wherein simultaneously wobbling comprises moving the upper end of the probe while rotating about an annular path around the vertical axis; and after the probe is driven into the ground, moving the probe upward from the ground along the vertical axis, leaving a hole in the ground, wherein moving the upper end comprises moving the upper end of the probe while rotating about the annular path of a circular shape concentric to the vertical axis, and wherein moving the upper end comprises rotating an output shaft relative to a mounting plate, rotatably mounting the probe in a sleeve rotatably mounted to the output shaft, and rotatably relating the output shaft and the probe.

6. The method of claim 5, wherein rotatably relating comprises providing a first gear on the output shaft, and providing a second gear on the probe in a gearing relation with the first gear.

7. The method of claim 5, wherein rotating the probe comprises providing a hydraulic motor having an output shaft, and coupling the probe to the output shaft; and wherein simultaneously wobbling comprises mounting the hydraulic motor to a mounting plate, coupling the probe to the output shaft by a universal joint, and bending the upper end to have a connection angle at a non-parallel angle to the probe axis of rotation.

8. The method of claim 7, wherein bending comprises bending the upper end to have an adjustable connection angle to the probe axis of rotation.

9. Apparatus for forming a hole in ground comprising, in combination:

a mounting plate adapted to be mounted to a bucket of a loader;

a probe including an upper end and a bottom end spaced from the upper end along a vertical axis perpendicular to the ground, with the bottom end of the probe being adapted for digging a hole in the ground;

a probe motor including an output shaft, with the upper end of the probe coupled to the output shaft;

a universal joint connecting the probe motor to the mounting plate, with the upper end of the probe movable relative to the mounting plate about a first axis perpendicular to the vertical axis and a second axis perpendicular to the vertical axis and perpendicular to the first axis, with the probe being moveable along the vertical axis into the ground by movement of the mounting plate by the loader to move the mounting plate along the vertical axis and simultaneously rotating and moving the probe about the first and second axes, and with the probe being movable out of the ground along the vertical axis to form a hole in the ground;

a movement plate movably mounted to the mounting plate in a plane generally perpendicular to the vertical axis, with the probe motor fixed to the movement plate; and a tie rod having a first end pivotably and rotatably attached to the mounting plate about a first axis parallel to and spaced from the output shaft and having a second end pivotably and rotatably attached to the movement plate about a second axis parallel to and spaced from the first axis, with the movement plate being orbitably movable in the first and second axes.

10. The apparatus of claim 9, further comprising, in combination: a movement motor connected to the movement plate and having an output shaft parallel to and spaced from the output shaft of the probe motor; and an orbital shaft fixed to the mounting plate parallel to and spaced from the output shaft of the movement motor, with the orbital shaft rotatably and tiltably interconnected to the output shaft of the movement motor spaced from and parallel to the output shaft of the movement motor.

11. The apparatus of claim 10, further comprising, in combination: a disk fixed to the output shaft of the movement motor, with the orbital shaft pivotably and tiltably received in the disk radially spaced from and parallel to the output shaft of the movement motor.

12. The apparatus of claim 9, with the upper end of the probe movable in an annular path of a circular shape concentric to the output shaft of the probe motor.

13. Apparatus for forming a hole in ground comprising, in combination:

a mounting plate adapted to be mounted to a bucket of a loader;

a probe including an upper end and a bottom end spaced from the upper end along a vertical axis perpendicular to the ground, with the bottom end of the probe being adapted for digging a hole in the ground;

a probe motor including an output shaft, with the upper end of the probe coupled to the output shaft, with the upper end of the probe movable in an annular path of a circular shape concentric to the output shaft of the probe motor;

a universal joint connecting the probe motor to the mounting plate, with the upper end of the probe movable relative to the mounting plate about a first axis perpendicular to the vertical axis and a second axis perpendicular to the vertical axis and perpendicular to the first axis, with the probe being moveable along the vertical axis into the ground by movement of the mounting plate by the loader to move the mounting plate along the vertical axis and simultaneously rotating and moving the probe about the first and second axes, and with the probe being movable out of the ground along the vertical axis to form a hole in the ground; and a sleeve rotatably mounted to the output shaft of the probe motor, with the upper end of the probe rotatably received in the sleeve, with the upper end of the probe being rotatably related to the output shaft of the probe motor.

14. The apparatus of claim 13, further comprising, in combination: a first gear on the output shaft of the probe motor; and a second gear on the upper end of the probe and in a gearing relation with the first gear.

15. The apparatus of claim 13, further comprising in combination: a movement plate movably mounted to the mounting plate in a plane generally perpendicular to the vertical axis, with the probe motor fixed to the movement plate.

* * * * *